United States Patent [19]

Mann

[11] Patent Number: 5,004,470

[45] Date of Patent: Apr. 2, 1991

[54] EARPIERCING CARTRIDGE ASSEMBLY

[75] Inventor: Samuel J. Mann, Englewood, N.J.

[73] Assignee: Inverness Corporation, Fair Lawn, N.J.

[21] Appl. No.: 541,454

[22] Filed: Jun. 21, 1990

Related U.S. Application Data

[63] Continuation of Ser. No. 471,689, Jan. 29, 1990, abandoned, which is a continuation of Ser. No. 193,472, May 13, 1988, abandoned.

[51] Int. Cl.[5] ..... A61B 17/34

[52] U.S. Cl. ..... 606/188

[58] Field of Search ..... 606/117, 188

[56] References Cited

U.S. PATENT DOCUMENTS 4,030,507 6/1977 Mann ..... 128/330

4,527,563 7/1985 Reil ..... 128/330 X

FOREIGN PATENT DOCUMENTS 2135171 8/1984 United Kingdom ..... 128/330

2142538 1/1985 United Kingdom ..... 128/330

*Primary Examiner*—Michael H. Thaler

*Attorney, Agent, or Firm*—Blum Kaplan

[57] ABSTRACT

A disposable earpiercing cartridge assembly for protecting the earpiercing gun and customer from contamination during piercing is provided. A stud cartridge releasably contains a pair of earring studs. A clutch cartridge releasably contains a pair of earring clutches. A spring gun for ejecting the earring stud from the stud cartridge causes the stud to leave the stud cartridge and pierce the ear and engage the clutch. The spring gun is adapted to selectively receive and position the stud cartridge and the clutch cartridge for piercing, the stud cartridge being positioned between the ear and the spring gun, while the clutch cartridge is positioned between the ear and an anvil of the spring gun.

14 Claims, 5 Drawing Sheets

EARPIERCING CARTRIDGE ASSEMBLY

This is a continuation of application Ser. No. 07/471689, abandoned, filed Jan. 29, 1990, which is continuation application of Ser. No. 07/193,472, filed on May 13, 1988, abandoned.

BACKGROUND OF THE INVENTION

This invention relates in general to a sterile earlobe piercing system and, in particular, to an earpiercing system utilizing a novel combination of an earpiercing gun, earring studs and earring clasps to facilitate sterile earpiercing.

Earpiercing systems using an earpiercing gun are well known in the prior art. Present earpiercing systems are particularly characterized by an earring stud with a sharpened point being inserted through the earlobe by a spring loaded instrument or gun. The pioneering earpiercing system for reducing the spread of infectious disease was a system manufactured and sold by Inverness Corporation, the assignee of this invention. The Inverness system is described and claimed in U.S. Pat. No. 4,030,507, issued to Samuel J. Mann.

The Inverness earpiercing system has proven to be effective in preventing the transmission of infectous disease. However, the Inverness system requires excessive handling of the earring cartridge after piercing of the first earlobe is completed. Also the Inverness system is complex and requires several components including a cartridge and cartridge housing which increases the cost thereof. Accordingly, a less complex ear piercing system wherein the handling of the ear piercing elements and, in particular, the disposable earring and clasp cartridge is reduced during operation is desired.

SUMMARY OF THE INVENTION

Generally speaking, in accordance with the instant invention, a pair of earpiercing studs and a pair of clasps are respectively housed in disposable cartridges to provide a sterile earlobe piercing system. These cartridges are inserted into an earpiercing instrument adapted to receive and hold the cartridges in a facing relationship. A push rod is provided for displacing an earring stud from the cartridge through the ear and into the clasp.

In an exemplary embodiment each cartridge is provided with a back wall having opposed flanges projecting therefrom. Each flange is provided with a centered groove therein to cooperate with a projection extending from the instrument. Each flange extends to a side wall. The cartridges are slid into tracks formed on the instrument and are automatically aligned with the push rod by the side walls.

Accordingly, it is an object of the instant invention to provide an improved ear piercing system.

A further object of the invention is to provide an ear piercing cartridge system which minimizes handling of the cartridge during earpiercing.

Another object of the instant invention is to provide an earpiercing system in which the stud and clutch are easily and accurately aligned prior to piercing the earlobe.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings in which.

DETAILED DESCRIPTION OF THE PREFERRED EMBODIMENTS

Figure 1:
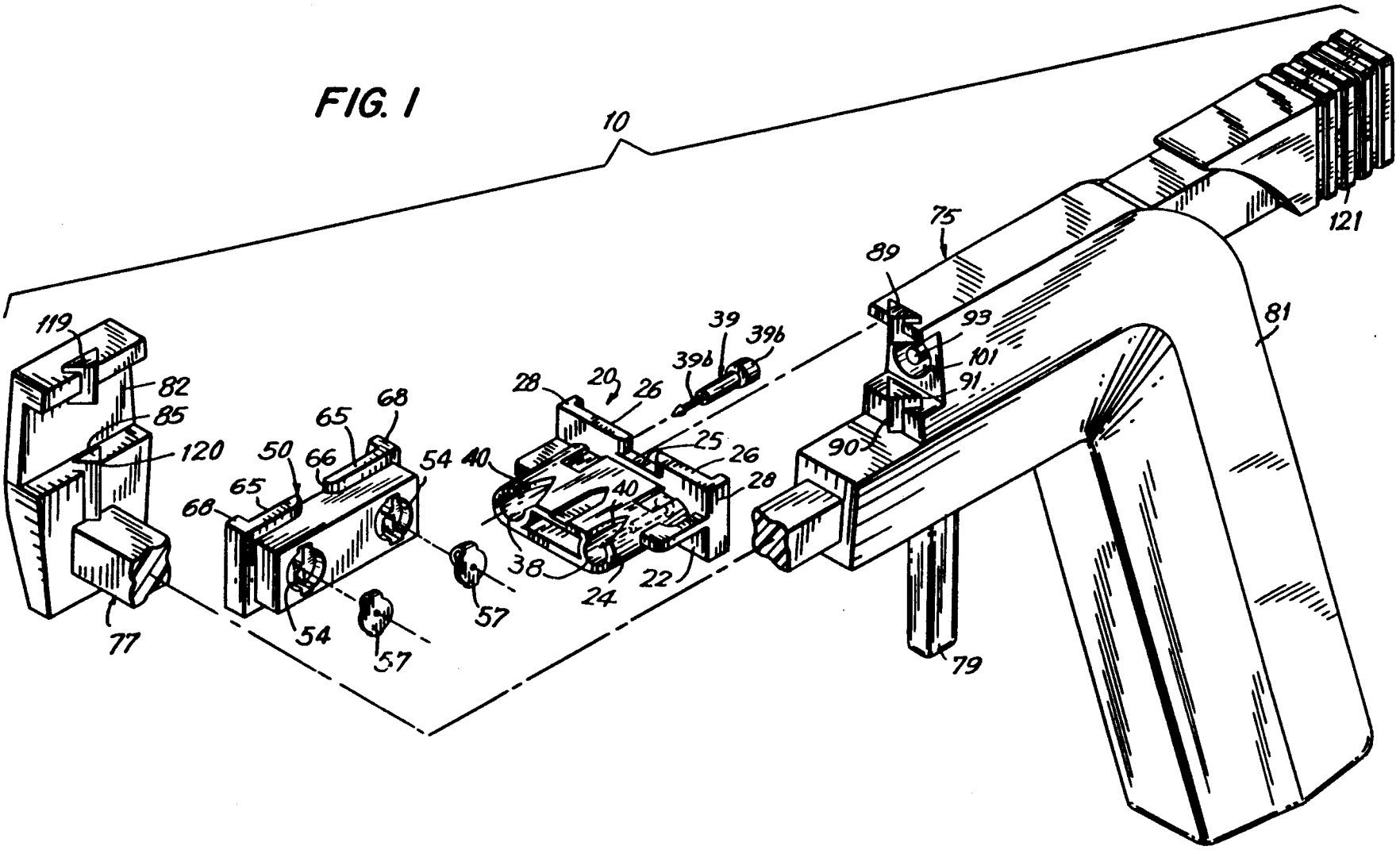
FIG. 1 is an exploded view of an earpiercing cartridge assembly constructed in accordance with the invention.

Reference is first made to FIG. 1 wherein an earpiercing cartridge assembly, constructed in accordance with the preferred embodiment of the instant invention, and generally indicated as 10, is depicted. The earpiercing cartridge assembly includes a stud cartridge, generally indicated as 20, a clutch cartridge, generally indicated as 50, and a spring gun generally indicated as 75.

Referring to FIGS. 1, and 7–10 stud cartridge 20 includes a support wall 22 and a casing 24 projecting from support wall 22 Opposed notches 25 are formed in the lengthwise edges of support wall 22 and define projecting flanges 26 on either side of notch 25. Stop walls 28 each extend at a substantially right angle from support wall 22. Two bores 38 axially extend through the length of casing 24 and support wall 22. Bore 38 receives a stud 39 having a head **39*a* and a piercing pin 39*b*, in parallel. The diameter of the bore 38 is dimensioned with respect to the size of each stud to lightly retain the studs therein by an interference fit. In an exemplary embodiment, U-shaped grooves 40 are disposed at the opening of bores 38 and are axially aligned with the piercing pin 39*b*** to facilitate aiming the piercing earring at the earlobe.

Figure 4:
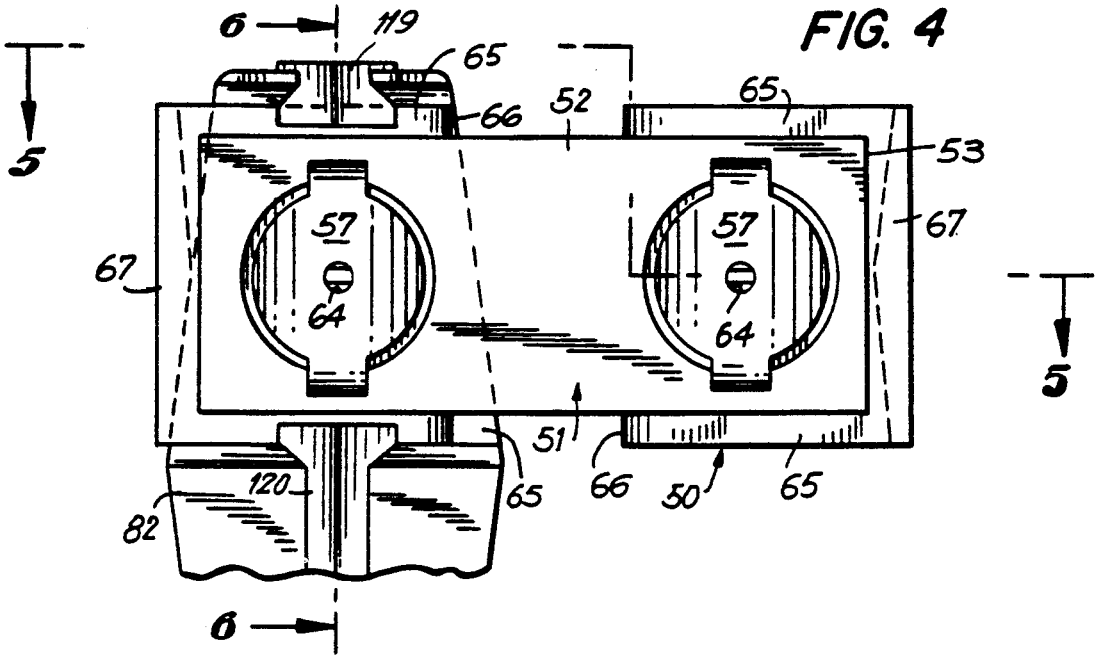
FIG. 4 is a sectional view taken along line 4—4 of FIG. 2.
Figure 5:
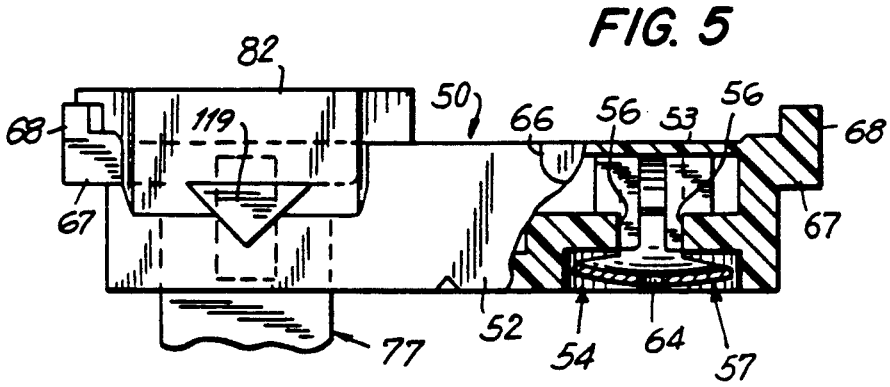
FIG. 5 is a sectional view taken along line 5—5 of FIG. 4.
Figure 6:
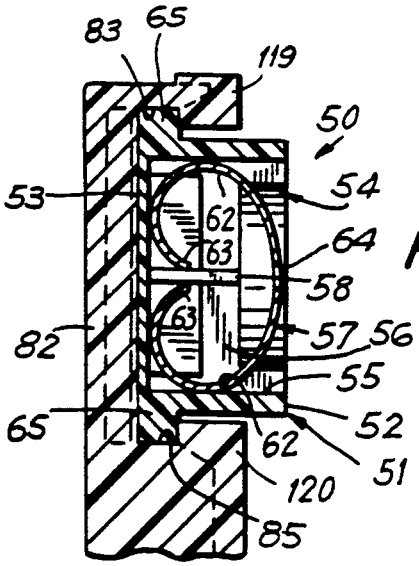
FIG. 6 is a sectional view taken along line 6—6 of FIG. 4.
Figure 7:
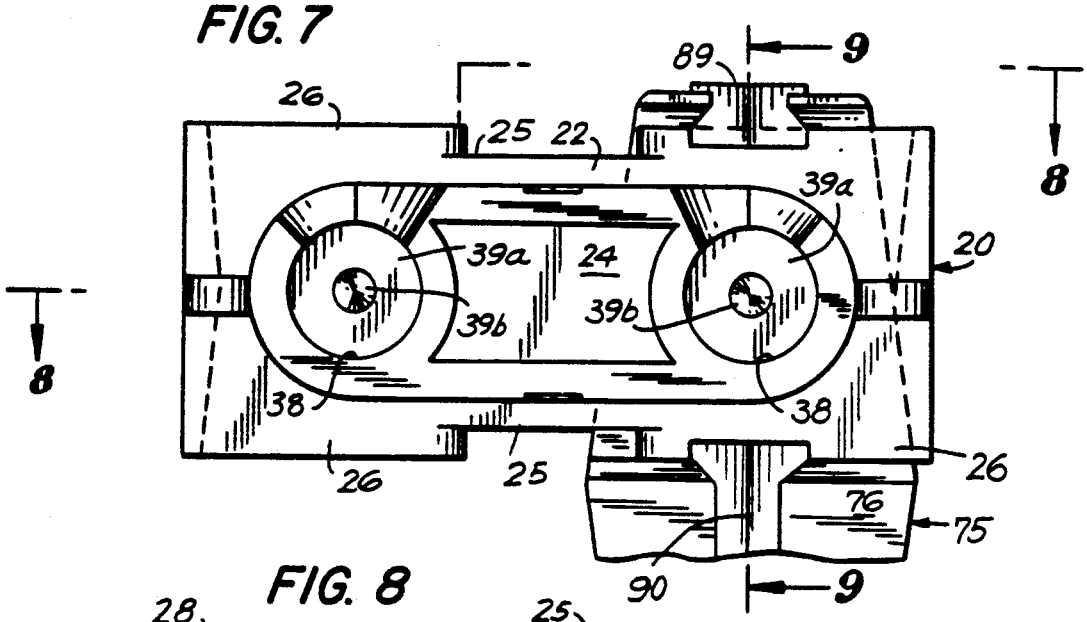
FIG. 7 is a sectional view taken along line 7—7 of FIG. 2.
Figure 8:
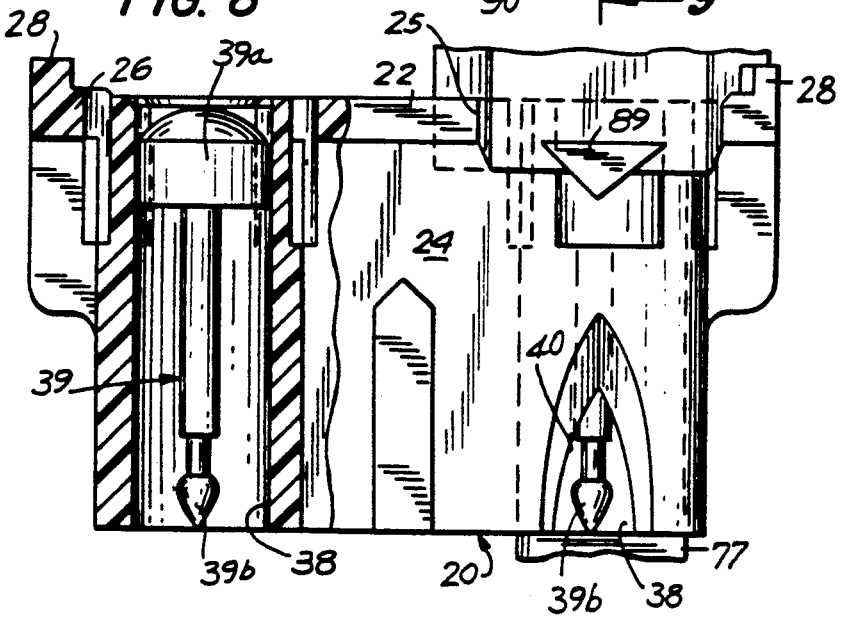
FIG. 8 is a sectional view taken along line 8—8 of FIG. 7.
Figure 9:
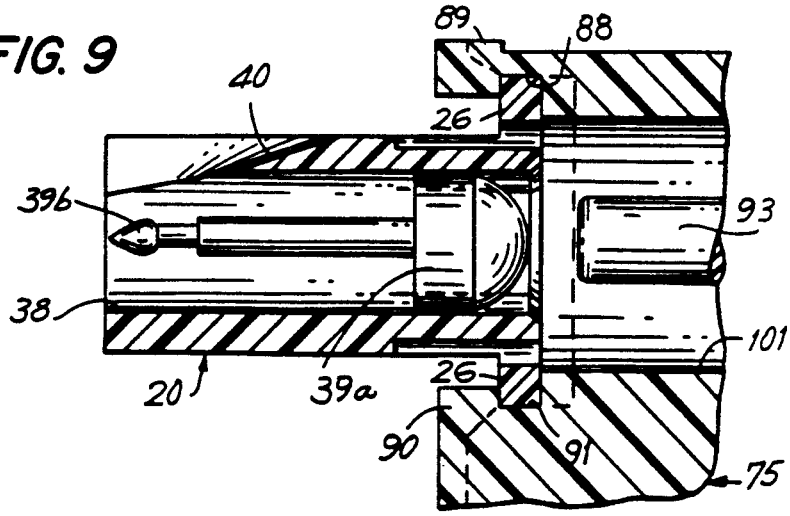
FIG. 9 is a sectional view taken along line 9—9 of FIG. 7.
Figure 11:
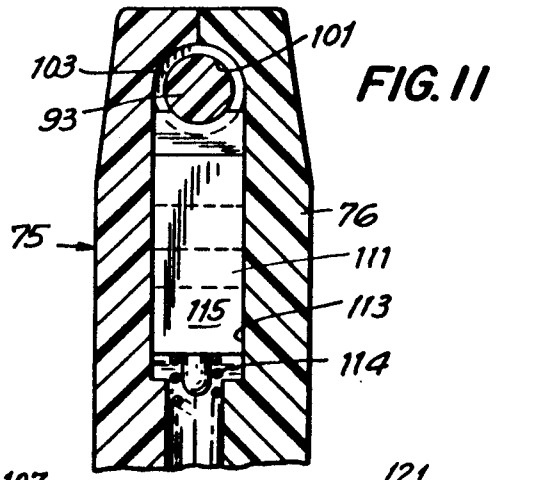
FIG. 11 is a sectional view taken along line 11—11 of FIG. 3.
Figure 10:
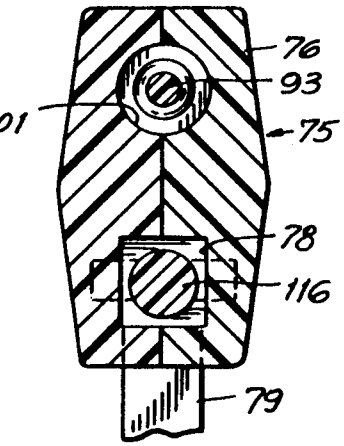
FIG. 10 is a sectional view taken along line 10—10 of FIG. 3.

Reference is now made to FIGS. 4 through 6 wherein a clutch cartridge assembly 50, including a clutch housing 51 and clutches 57 is depicted. Housing 51 includes a solid molded casing 52, having two symmetrical positioning walls 53 projecting therefrom.

Each clutch 57 is formed of a single piece of resilient metal having a C-shaped configuration forming two symmetrical loops 62, having ends 63. An opening 64 is provided in the metal for receiving the piercing pin **39*b*** of an earring and is coaxial with the space between ends 63.

Casing 52 includes two clutch chambers 54 formed by blind holes 55. Struts 56 are formed in each blind hole 55 for positioning clutches 57 therein. The blind holes 55 are of sufficient depth to permit the clutch to be recessed from the outer surface of the casing defining the housing so that the clutch is prevented from coming into contact with a person's finger when the clutch cartridge is inserted into the gun and is slideably displaced therein. A nib 58 projects from each strut and is adapted to rest between the end 63 and loops 62 of each clutch 57 to position and secure clutch 57 in clutch chamber 54. When piercing pin 39*b* enters the opening 64 and continues until it is between ends 63 of loop 62, the ends 63 are spread apart and no longer held by the nibs 58. Accordingly, each clutch chamber 54 is configured to releasably secure clutch 57 therein until the clutch 57 is secured on the piercing pin 39*b* of an earring after the earlobe has been pierced.

Positioning walls 53 include a bottom and top flange 65 which form therebetween notches 66 and side flanges 67 which include stop walls 68 at a right angle with respect thereto. As will be explained in detail below, the positioning walls 53 permit the clutch cartridge assembly to be exactly positioned in the earpiercing gun 75.

Reference is now made to FIGS. 2, 3, and 10–12 wherein spring gun 75 is depicted. Spring gun 75 includes a two-piece frame comprised of a housing 76, a plunger 77, and a push rod assembly 80. Plunger 77 includes a depending handle 79 for providing a finger grip. At the handle end of housing 76 extends a handle assembly, generally indicated as 81. An anvil 82 is provided on plunger 77 opposed and at a distance from push rod assembly 80. Anvil 82 is provided with an upper slot 83 formed between a projection 119 and anvil 82 and a lower slot 85 formed between a projection 120 and anvil 82 for receiving flanges 65 of cartridge 50. Accordingly, clutch cartridge 50 may be slid into anvil 82 for positioning during piercing.

Projections 119, 120 are sized to pass through notches 66 of clutch cartridge 50. Clutch cartridge 50 is pushed into gun 75 and is then slid in either direction of arrow A, pinning bottom and top flanges 65 between projections 119, 120 and anvil 82, securing clutch 57 in proper position for piercing.

Figures 2, 3:
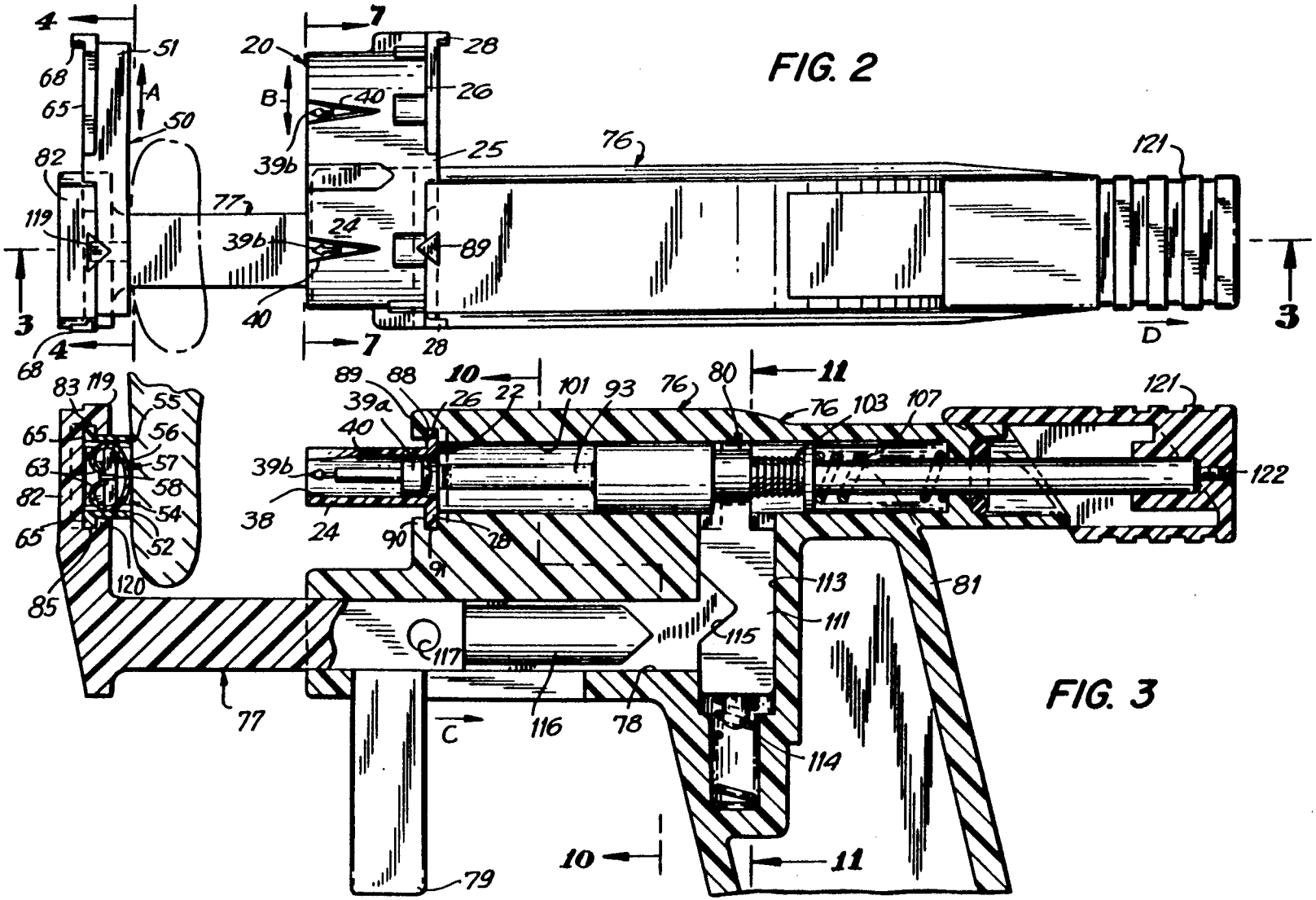
FIG. 2 is a top plan view of the dovetail earpiercing cartridge assembly depicted in FIG. 1.
FIG. 3 is a sectional view taken along line 3—3 of FIG. 2 showing the invention prior to ear piercing.
Figure 12:
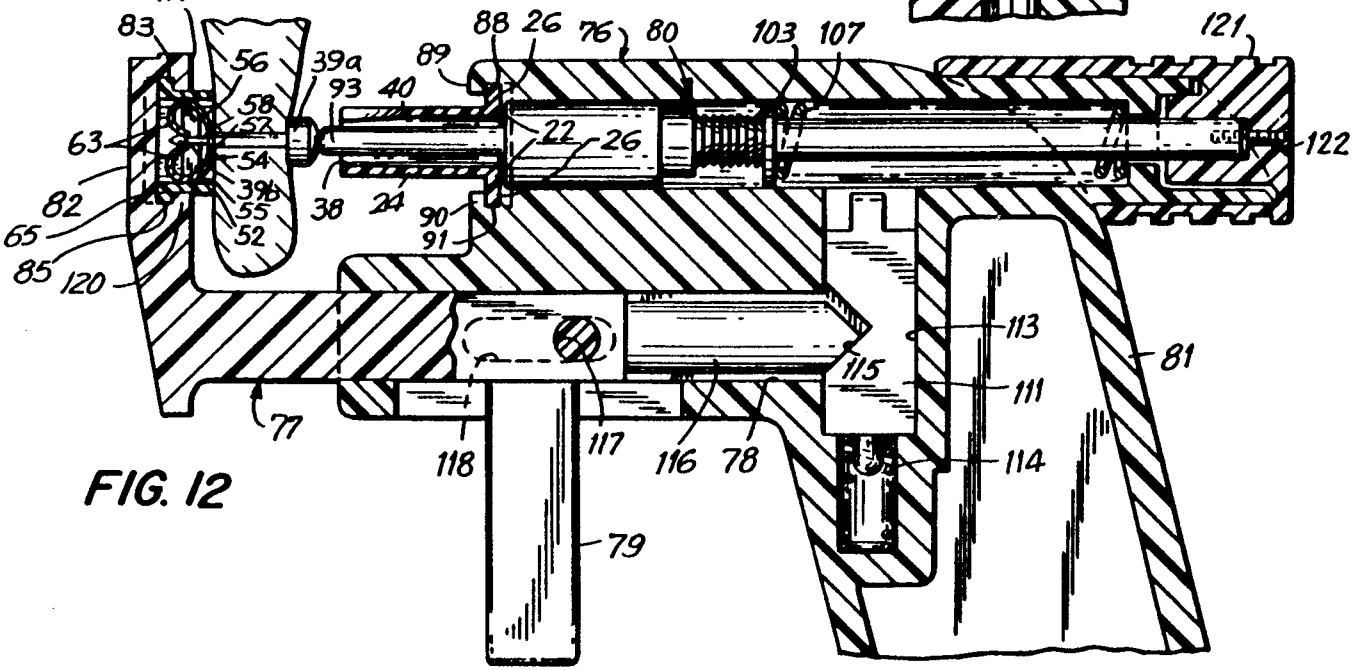
FIG. 12 is a sectional view of the earpiercing instrument showing the stud and clutch after the instrument has been fired.

A projection 89 is triangularly shaped to assist in guiding the insertion of the clutch cartridge and aiming of the gun during use and is integrally formed on housing 76 and forms an upper slot 88 between projection 89 and housing 76. Projection 89 also facilitates alignment into the gun. Similarly, a lower triangularly shaped projection 90 integrally formed with housing 76 forms a lower slot 91 between lower projection 90 and housing 76. Again, projections 89 and 90 are configured to pass through notches 25 of cartridge 20 so that cartridge 20 may be slid through slots 88, 89 in either direction of arrow B retaining stud cartridge 20 in proper position for piercing A push rod 93 is slideably contained within a bore 101 of housing 76. A circular flange 103 is rigidly secured to push rod 93. A spring 107 biases push rod 93 in the direction of anvil 82. A catch 111 slidably mounted within a bore 113 contacts flange 103 preventing push rod 93 from sliding through bore 101 prior to firing (FIG. 3). Catch 111 may slide away from push rod 93 allowing push rod 93 to slide forward and extend through bore 38 of stud cartridge 20. (FIG. 12).

Catch 111 is biased towards push rod 93 by a spring 114 mounted in bore 113. A triangular notch 115 formed in catch 111 is positioned substantially midway along catch 111. A triangular projection 116 extends from floor 77 in bore 78 towards catch 111. Moving handle 79 in the direction of arrow C causes projection 116 to enter notch 115 of catch 111 to slide catch 111 down as shown in FIG. 12 releasing push rod 93. Spring 114 biases catch 111 in the direction of arrow B causing projection 116 to return to the ready position.

Anvil 82 is integrally formed with handle 79 therefore drawing anvil 82 towards push rod 93 during firing, thus ensuring the close proximity of each clutch 57 and stud 39 to the earlobe being pierced. A pin 117 fixed relative to handle 79 is provided within a groove 118 When handle 79 has been pulled a distance allowing stud 39 to enter clutch 57, pin 117 comes in contact with groove 118 preventing further squeezing of handle 79 ensuring that handle 79 is pulled only enough to lightly squeeze the earlobe to secure the earlobe in place prior to piercing the ear, thereby preventing any forceful contact of cartridges 50 or 20 with the ear. When the handle 79 has been released pin 117 contacts groove 118 in the opposite direction preventing floor 77 from being pushed out of housing 76.

A rear handle 121 extending without housing 76 is secured to push rod 93 by a screw 122 and allows quick reloading of push rod 93. After firing, handle 121 is slid in the direction of arrow D pulling push rod 93 in the same direction releasing catch 111 which engages flange 103 in the prefiring position.

To automatically assure the alignment of push rod 93, stud 39 and clutch 57 during firing, the distance from the center of chamber 54 to left stop wall 68 corresponds to the distance from the edge of anvil 82 to the axis of push rod 93. Similarly, the distance from right side wall 68 to opening 54 is the distance from the edge of anvil 82 to the axis of push rod 93. Accordingly, the proper alignment of each clutch 57 with push rod 93 is assured by bringing the inner surface of wall 68 in contact with the outer edge of anvil 82. Similarly, the distance from each stop wall 28 to bore 38 is equal to the distance from the edge of spring gun 75 to bore 101. Accordingly, proper alignment of stud 39 with push rod 93 is assured by bringing the inner edge of either side wall 28 in contact with the edge of spring gun 75. A similar, but not as effective, result could be obtained by utilizing detents (not shown) positioned in the clutch cartridge assembly and by providing projections in the anvil for indexing the indents In operation a stud cartridge 20 is removed from its sterile container (not shown) and is slid into slots 88, 91 of housing 76 until side wall 28 aligns stud 39 with push rod 93. Similarly, clutch cartridge 50 is also removed from a sterile container (not shown) and is slid through slots 83, 85 until positioning side wall 66 contacts anvil 82. Again, since the distances from stop wall 68 to the center line of chamber 54 is the same as the distance from the side of anvil 82 to the center line of the axis of bore 101 and pushrod 93 and sidewall 28 is the same distance from bore 38 as bore 101 is from the side of housing 76; push rod 93, stud 39 and clutch 57 are all coaxial and, therefore, automatically aligned The place on the earlobe to be pierced is marked with a sterile pen or the like to indicate the appropriate piercing position. In an exemplary embodiment cartridge 20 is aligned with the marking on the earlobe by means of aiming groove 40. Aiming groove 40 permits the operator to see the tip of stud 39 but is sized to prevent touching stud 39. The tip of stud 39 is aligned with the mark on the earlobe by the operator After alignment, the operator pulls handle 79 causing push rod 93 to pass through cartridge 20; forcing stud 39 through stud cartridge 20 and the earlobe Piercing pin **39*b* has a diameter greater than nib 58. As piercing pin 39*b* passes through opening 64, piercing pin 39*b* passes between ends 63, spreading ends 63 farther from each other causing clutch 57 to secure stud 39. After firing gun 75, anvil 82 returns to its pre-firing position, releasing clutch 57 from clutch cartridge 50, which is attached to the earlobe by stud 39**.

Cartridges 20, 50 are disposed between the earlobe and gun 75, therefore any splashing of blood or other body fluids are prevented from reaching the plunger 77 or handle 76 or any other components comprising the system. This eliminates the necessity of sterilizing the instrument after each use, which is costly and time consuming and impractical in most working environments and, thus, preventing the spread of contaminants to the next user. Conversely since the earlobe only contacts disposable cartridges 50, 20, studs 39, 39 or clutches 57, 57 it only contacts sterile surfaces thereby removing the need to sterilize gun 75. Since these cartridges are hermaphroditic, they may be inserted from either side or into either end of the receiving flanges. This simplifies handling and accommodates the system equally to right or lefthanded operators.

In the preferred embodiment cartridges 20 and 50 are made of plastic so as to be lightweight, sturdy and disposable. The cartridges may be transparent to further aid in aiming. Bores 38 of stud cartridge 20 have a minor diameter ranging from 0.001 inches to 0.005 inches less than the outer diameter of studs 39 and extend for a length of 0.09 inches to 0.125 inches along the length of studs 39 to secure the stud in place during shipping and handling. The major inches larger than the outer diameter of stud 39 to permit the stud to slide through cartridge 20 without friction.

Nibs 56 are separated by a gap of 0.02 inches. The width of each stud 39 is 0.032 inches, greater than the 0.02 inch width of each nib pair, thereby causing lobes 57 of each clutch 57 to open to this dimension freeing clutches 57 from cartridge 50 when pierced by stud 39.

It will thus be seen that the objects set forth above, among those made apparent from the preceding description are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An earpiercing cartridge assembly for piercing an ear comprising: a first and second earring stud and stud cartridge means for releasably supporting both of said earring studs; first and second clutches and a clutch cartridge means for releasably supporting both of said earring clutches; earpiercing instrument means including a push rod, for slideably supporting and positioning said stud cartridge means with respect to said push rod, said stud cartridge means including positioning means associated therewith and cooperating with said earpiercing instrument means so that said stud cartridge means is slideably displaceable relative to said earpiercing instrument means, without requiring removal from said earpiercing instrument means so that each of said first and second earring studs is adapted to be selectively slideably displaced into coaxial alignment with said push rod.

2. The earpiercing cartridge assembly of claim 1, wherein said positioning means includes a stop at each side thereof, said stud cartridge means being adapted to position said earrings disposed therein at a predetermined position, each of said stops being adapted to cooperate with said instrument means to position said stud cartridge so that one of said first stud and said second stud and one of said first clutch and said second clutch are coaxially aligned with respect to each other.

3. The earpiercing cartridge assembly, of claim 1 wherein said stud cartridge means includes a first bore and said second bore dimensioned to frictionally secure a first and second earring studs respectively therein and is configured to permit said earring studs to be displaced therefrom.

4. The earpiercing cartridge assembly of claim 3, wherein each said stud includes a piercing pin having a predetermined diameter, said clutch cartridge means including a cartridge, a first and second blind hole therein, each said blind hole having a pair of opposed struts extending the height thereof, a first nib extending between said struts, a second nib extending between said struts and opposed to said first nib and separated by a distance less than the diameter of each said pin, said nibs being positioned to be engaged by said clutch, and said blind hole being dimensioned to prevent contact of said clutch by a user.

5. The earpiercing cartridge assembly of claim 4, wherein the earpiercing instrument means includes a centerline, an anvil, the clutch cartridge means being supported by said anvil a first and second stop wall on two opposed sides of said stud cartridge means, said bore being a distance from each said stop wall of said stud cartridge equal to the distance from a side edge of said earpiercing instrument to the centerline of said earpiercing means and of said push rod so that said one of said first and second clutches and one of said first and second stud are coaxially aligned with each other.

6. The earpiercing cartridge assembly, of claim 3, further comprising aiming means for aiming one of said first and second studs at said ear.

7. The earpiercing cartridge assembly of claim 6, wherein said aiming means comprises a first groove formed at the exit end of said first bore and a second groove formed at the exit end of said second bore, each groove being dimensioned to allow viewing of each said stud but not touching of each said stud by the user.

8. The earpiercing cartridge assembly of claim 1, wherein each said stud cartridge includes a piercing pin having a predetermined diameter, said clutch cartridge means including a cartridge, a first and second blind hole therein, each said blind hole having a pair of opposed struts extending the height thereof, a first nib extending between said struts, a second nib extending between said struts and opposed to said first nib and separated by a distance less then the diameter of each said pin said nibs being positioned to be engaged by said clutch and each said blind hole being dimensioned to prevent contact of said clutch by a user.

9. The earpiercing cartridge assembly of claim 1, wherein said earpiercing instrument means releasably supports said stud cartridge means and said clutch cartridge means.

10. The earpiercing cartridge assembly of claim 1, wherein said earpiercing instrument means slideably positions and supports said clutch cartridge means with respect to said stud cartridge and said push rod and said clutch cartridge means includes positioning means associated therewith and cooperates with said earpiercing instrument means so that said clutch cartridge means is slideably displaced without requiring removal from said earpiercing instrument means so that each of said first and second clutches is adapted to be selectively and slideably displaced into coaxial alignment with said push rod.

11. The earpiercing cartridge assembly of claim 10, wherein the earpiercing instrument includes a centerline, an anvil, the clutch cartridge means being supported by said anvil and said supporting and positioning means comprises a first and second stop wall extending from two opposed sides of said clutch cartridge means, the clutch cartridge means including a cartridge and a first and second blind hole therein, each said blind hole being a distance from each said stop wall of said clutch cartridge equal to the distance from a side edge of said anvil to the centerline of said earpiercing instrument means and of said push rod, a third and fourth stop wall of two opposed sides of said stud cartridge, the stud cartridge means being formed with a first bore and a second bore therein, each said bore being a distance from each said stop wall of said stud cartridge equal to the distance from a side edge of said earpiercing instrument to the centerline of said earpiercing instrument means and of said push rod, so that one of said first and second clutched and one of said first and second studs are coaxially aligned with each other.

12. The earpiercing cartridge assembly of claim 11, wherein said earpiercing instrument means includes a housing, said push rod being slideably supported in said housing, said anvil being integrally formed on said earpiercing instrument means opposite said push rod and said supporting and positioning means further comprises a first upper slot formed on said anvil, a first lower slot formed on said anvil, said clutch cartridge being supported in said first upper and lower slots, and a second upper slot formed on said housing above said push rod and a second lower slot formed on said housing below said push rod, said stud cartridge being supported in said second upper and lower slots.

13. An earpiercing cartridge assembly for piercing an ear comprising: a first and second earring stud and stud cartridge means for releasably supporting both of said earring studs; first and second clutches and a clutch cartridge means for releasably supporting both of said earring clutches; earpiercing instrument means including a push rod, for slideably positioning and supporting said clutch cartridge means with respect to said push rod, said clutch cartridge means including positioning means associated therewith and cooperating with said earpiercing instrument means so that said clutch cartridge means is slideably displaceable relative to said earpiercing instrument means without requiring removal from said earpiercing instrument means so that each of said first and second clutches is adapted to be selectively slideably displaced into coaxial alignment with said push rod.

14. The earpiercing cartridge assembly of claim 13, wherein said earpiercing instrument means slideably supports and positions said stud cartridge means with respect to said clutch cartridge means and said push rod, and said stud cartridge means includes positioning means associated therewith and cooperates with said earpiercing instrument means so that said stud cartridge means is slideably displaced without requiring removal from said earpiercing instrument means so that each of said first and second earring studs is adapted to be selectively slideably displaced in coaxial alignment with said push rod.

* * * * *